US007851722B2

(12) United States Patent
Ito et al.

(10) Patent No.: US 7,851,722 B2
(45) Date of Patent: Dec. 14, 2010

(54) OPTICAL CRACKED-GRAIN SELECTOR

(75) Inventors: Takafumi Ito, Tokyo (JP); Masazumi Hara, Tokyo (JP); Masahiro Egi, Tokyo (JP); Takahiro Doi, Tokyo (JP)

(73) Assignee: Satake Corporation, Tokyo (JP)

( * ) Notice: Subject to any disclaimer, the term of this patent is extended or adjusted under 35 U.S.C. 154(b) by 287 days.

(21) Appl. No.: 11/808,002

(22) Filed: Jun. 5, 2007

(65) Prior Publication Data

US 2007/0262002 A1 Nov. 15, 2007

(30) Foreign Application Priority Data

Jun. 15, 2006 (JP) ..... 2006-165995
Feb. 7, 2007 (JP) ..... 2007-028188

(51) Int. Cl.
*B07C 5/00* (2006.01)

(52) U.S. Cl. ..... 209/588; 209/576; 209/577; 250/226; 356/407

(58) Field of Classification Search ..... 209/576, 209/577, 588
See application file for complete search history.

(56) References Cited

U.S. PATENT DOCUMENTS 3,871,774 A * 3/1975 Murata ..... 356/432
4,096,949 A * 6/1978 Hoover et al. ..... 209/564
4,572,666 A * 2/1986 Satake ..... 356/239.1
4,830,194 A * 5/1989 Kajiura et al. ..... 209/580
4,975,863 A * 12/1990 Sistler et al. ..... 382/110
5,135,114 A * 8/1992 Satake et al. ..... 209/558
5,245,188 A * 9/1993 Satake et al. ..... 250/341.7
5,443,164 A * 8/1995 Walsh et al. ..... 209/580
5,538,142 A * 7/1996 Davis et al. ..... 209/580
6,013,887 A * 1/2000 Satake et al. ..... 209/581
6,078,018 A * 6/2000 Davis et al. ..... 209/580
6,097,493 A * 8/2000 Satake et al. ..... 356/609
6,646,218 B1 * 11/2003 Campbell et al. ..... 209/582
6,888,954 B2 * 5/2005 Leide et al. ..... 382/110
7,016,043 B2 * 3/2006 Fukumori et al. ..... 356/432
2005/0067332 A1 * 3/2005 Ikeda et al. ..... 209/587

FOREIGN PATENT DOCUMENTS

JP 59003354 A * 1/1984
JP 59007262 A * 1/1984
JP 59007263 A * 1/1984

(Continued)

*Primary Examiner*—Stefanos Karmis
*Assistant Examiner*—Jeremy Severson
(74) *Attorney, Agent, or Firm*—Staas & Halsey LLP

(57) ABSTRACT

An optical cracked-grain selector that does not mistakenly identify normal grains of rice having no cracks as cracked grains due to the presence of the embryonic portion and/or surface scratches when optically identifying cracked grains of rice mixed in with material rice grains. An identification part in a cracked grain identification unit obtains a first rice grain image (having an embryonic portion and scratches) based on light passed through the rice grain that is received by a first CCD sensor built into a CCD camera of a photoreaction detection unit and a second rice grain image (having cracks, an embryo portion and scratches) based on light passed through the rice grain received by a second CCD sensor built into the CCD camera, acquires an image of the cracks by calculating a difference in the amount of light between the two rice grain images, and identifies a cracked grain.

4 Claims, 8 Drawing Sheets

FOREIGN PATENT DOCUMENTS

| | | | | |
|---|---|---|---|---|
| JP | 59007264 | A | * | 1/1984 |
| JP | 59023248 | A | * | 2/1984 |
| JP | 59145951 | A | * | 8/1984 |
| JP | 05133905 | A | * | 5/1993 |
| JP | 08075657 | A | * | 3/1996 |
| JP | 09126653 | A | * | 5/1997 |
| JP | 11-218495 | | | 8/1999 |
| JP | 3020041 | B2 | * | 3/2000 |
| JP | 2001-145855 | | | 5/2001 |
| JP | 2003254911 | A | * | 9/2003 |
| JP | 2005-265519 | | | 9/2005 |
| JP | 2008190936 | A | * | 8/2008 |

* cited by examiner

FIRST IMAGE
OF RICE GRAIN

SECOND IMAGE
OF RICE GRAIN

FIRST IMAGE OF
RICE GRAIN

SECOND IMAGE
OF RICE GRAIN

CRACK IMAGE
(ONLY CRACKS REMAIN)

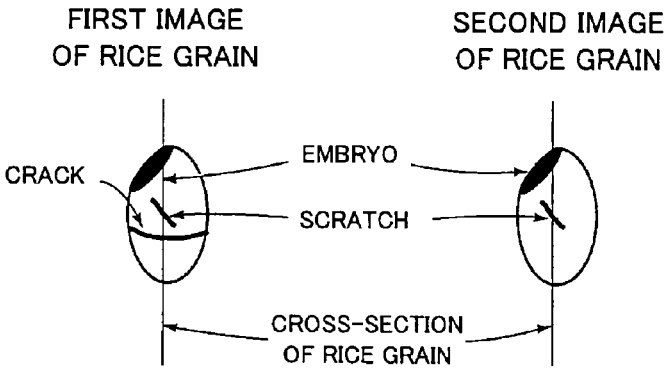
FIG.8a
FIG.8b
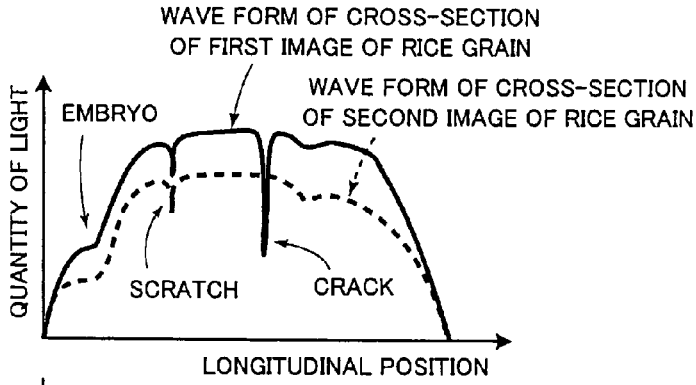
FIG.8c
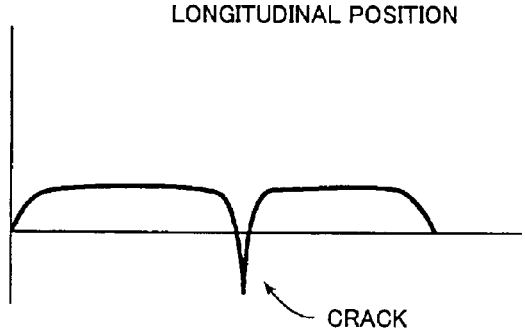
FIG.8d
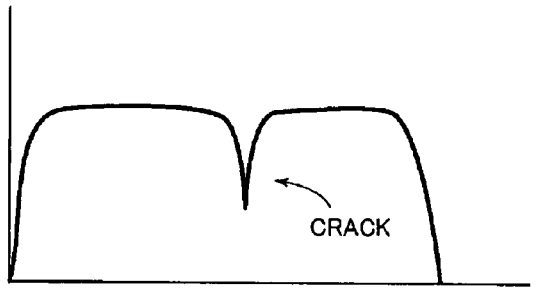
FIG.8e
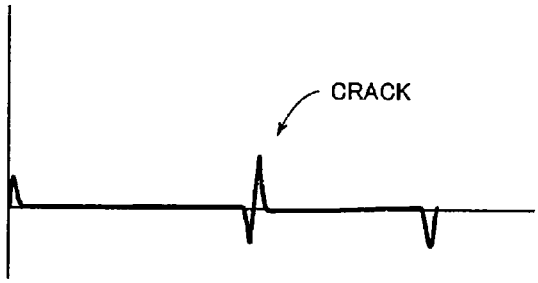

OPTICAL CRACKED-GRAIN SELECTOR

BACKGROUND OF THE INVENTION

1. Field of the Invention

The present invention relates to an optical cracked-grain selector that optically determines and selects for removal cracked grains in material rice grains such as brown rice, polished rice and the like.

2. Description of Related Art

Conventionally, an optical cracked-grain selector apparatus that optically detects and selects grains of rice having one or more cracks that penetrate to the interior of the grain (hereinafter "cracked grain" or "cracked grains") is known, such as those disclosed in JP2005-265519A and JP3642172B. In general, the above-mentioned crack in the rice grain usually extends in a direction substantially perpendicular to a longitudinal direction of the rice grain. As shown for example in FIG. 10, a conventional optical cracked-grain selector 100 comprises a slanted chute 200 for pouring the material rice grains downward, and optical detecting means 300 and selection means 400 disposed near a bottom end of the slanted chute 200 at positions along a downward trajectory G of fall of the material rice grains. The optical detecting means 300 has an emitter 300*a* disposed on one side of the trajectory G of fall that emits a line-like laser beam of light toward an optical detection position P on the trajectory G of fall and a CCD (charge-coupled device) camera 300*b* disposed on the other side of the trajectory G of fall that detects light at the optical detection position P. Such an optical cracked-grain selector 100 sends the material rice grains down the slanted chute 200, irradiates the material rice grains with the optical detecting means 300 when they pass the optical detection point P on the trajectory G of fall so as to capture the light passed through the grains with the CCD camera 300*b*, processes signals using cracked grain identification means 500 separately provide and identifies cracked grains based on received light data, and selects the identified cracked grains for removal using the selection means 400.

However, the optical cracked-grain selector 100 described above has the following problem. Specifically, the cracked grain identification means 500 identifies a total image (total visual image) of each grain of rice based on the received light data and identifies a cracked grain whenever it detects linear dark shades of data corresponding to cracks in the image of each grain thus identified. However, each grain of rice has an embryonic portion and sometimes also surface cracks in the skin (hereinafter "scratches"), and it is known that the embryonic portions and the scratches adversely affect identification accuracy when identifying cracked grains. In other words, when the embryonic portion and scratches are present in the rice grain, they show up as dark shadows just like cracks, and for that reason normal grains having no cracks are wrongly identified as cracked grains, causing a decline in product yield.

SUMMARY OF THE INVENTION

The present invention provides an optical cracked-grain selector that does not mistakenly identify normal grains of rice having no cracks as cracked grains due to the presence of the embryonic portion and/or surface scratches when optically identifying cracked grains of rice mixed in with material rice grains.

An optical cracked-grain selector of the present invention selects cracked grains in a plurality of rice grains. The optical cracked-grain selector comprises: conveying means for conveying the rice grains aligned in a plurality of rows; optical detecting means including a light emitting section for emitting planar beams of light toward an optical detecting position on trajectories of motion of the rice grains ejected from the conveying means, and a camera for detecting light passed through each of the rice grains at the optical detecting position, the light emitting section including a first-color light emitter and a second-color light emitter for emitting a first-color light and a second-color light, respectively, of different wavelengths, the first-color light emitter comprising a pair of emitting units arranged such that substantially the same interior angles are formed between respective optical axes of the emitting units and an optical axis of the camera, or a single emitting unit arranged on the optical axis of the camera, the second-color light emitter comprising a single emitting unit arranged such that an optical axis thereof does not coincide with the optical axis of the camera, the camera being arranged such that the optical axis thereof intersects the trajectories of motion of the rice grains substantially perpendicularly at the optical detecting position and having a first light receiving section and a second light receiving section for receiving the first-color light and the second-color light, respectively; cracked grain determining means for determining cracked grains in the rice grains by detecting a crack in each of the rice grains based on the lights received by the first light receiving section and the second light receiving section of the camera; and selecting/separating means for selecting and separating the cracked grains determined by the crack determining means.

The first-color light and the second-color light may comprise two of red light having wavelength of 600 nm-710 nm, green light having wavelength of 500 nm-580 nm, and blue light having wavelength of 420 nm-520 nm.

The interior angles formed between the respective optical axes of the pair of emitting units of the first-color light emitter and the optical axis of the camera are preferably not greater than 70 degrees.

The pair of emitting units of the first-color light emitter may be arranged symmetrically with respect to a plane containing the optical axis of the camera.

The first-color light emitter and the second-color light emitter may be composed of light emitting diodes.

The first light receiving section and the second light receiving section of the camera may comprise a first CCD sensor and a second CCD sensor, respectively, which are separately provided.

The first CCD sensor and the second CCD sensor may be color CCD line sensors, and the camera may be provided with light dispersing means for dispersing light passed through the rice grains at the optical detection position into the first color and the second color to be inputted in the respective color CCD line sensors.

The cracked grain determining means may create a first image and a second image of each of the rice grains based on the light received by the first light receiving section and the light received by the second light receiving section, respectively, and may detect a crack in each of the rice grains based on a difference in quantity of lights of the first image and the second image.

According to the optical cracked-grain selector of the present invention, the identification unit mounted on the crack determining means forms a first rice grain image showing cracks, embryo and scratches based on light passed through the rice grain and detected by the first CCD built into the CCD camera as well as a second rice grain image showing the embryo and scratches based on light passed through the rice grain and detected by the second CCD built into the CCD camera, cancels out images of the embryo and scratches by calculating the difference in the amount of light between these two images and acquires (identifies) a crack image showing only cracks, and determines whether or not the rice grain is a cracked grain based on the crack image. As a result, when identifying cracked grains, there are no more misidentifications of normal grains having no cracks as cracked grains due to the effect of images of the embryo and scratches, and accordingly, cracked grains can be correctly selected for removal, thus improving product yield.

BRIEF DESCRIPTION OF THE DRAWINGS

FIGS. 8*a*-8*e* illustrate in detail the subtraction process shown in FIG. 7;

DETAILED DESCRIPTION

A detailed description will now be given of a preferred embodiment of the present invention, with reference to the drawings.

Figure 1:
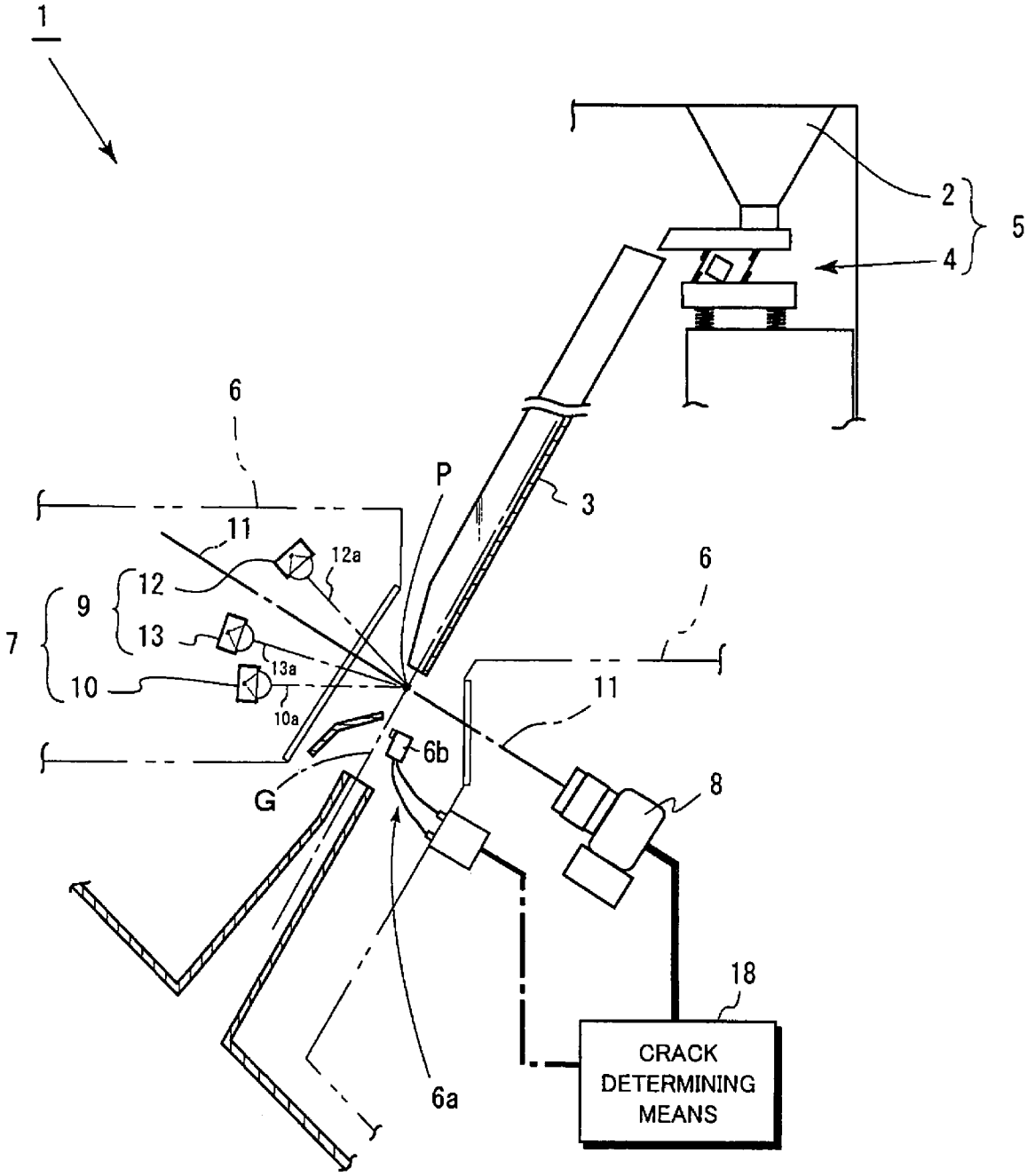
FIG. 1 is a vertical side sectional view of an optical cracked-grain selector of the present invention.
Figure 2:
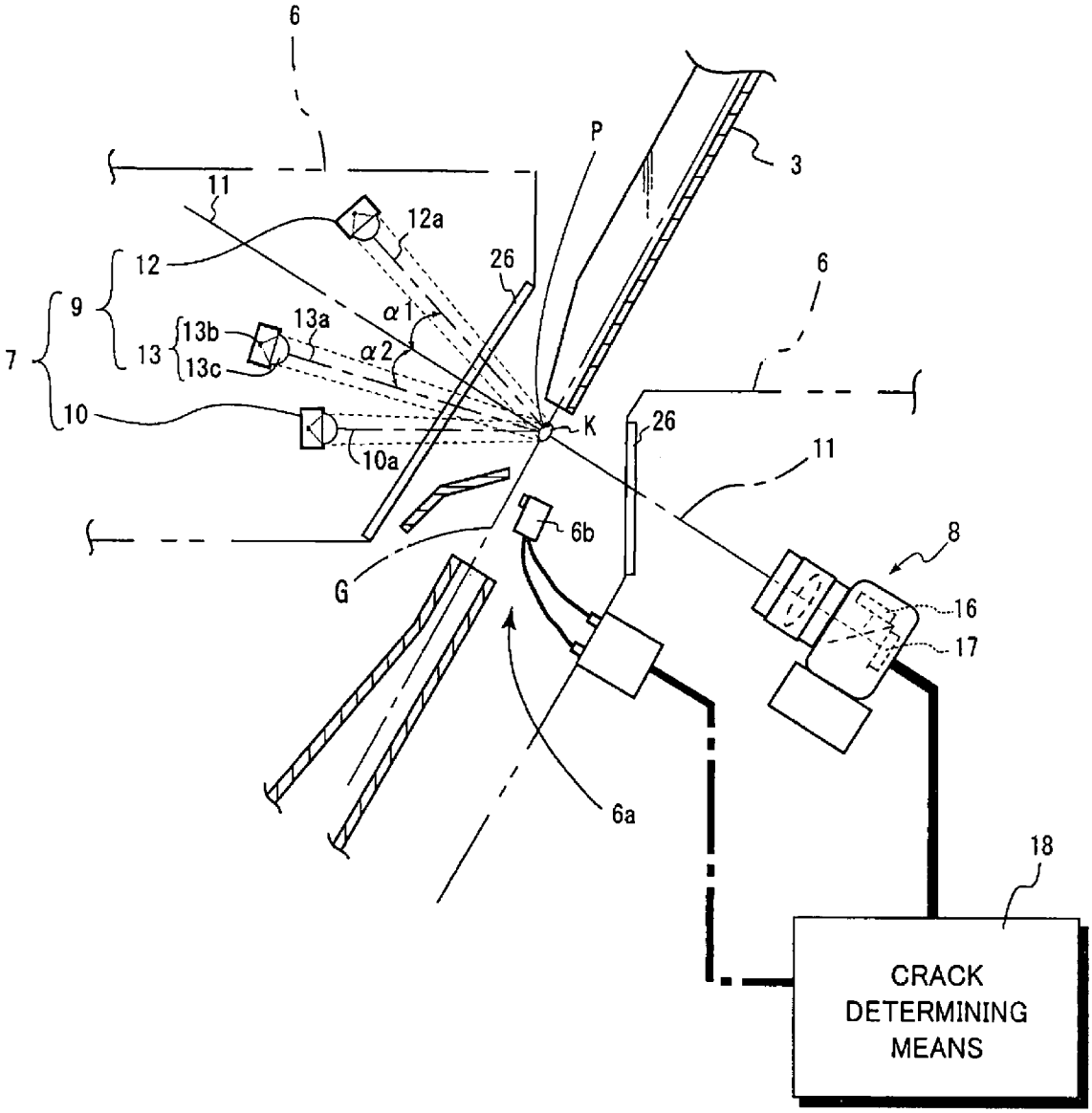
FIG. 2 is an enlarged view of the main parts of the optical cracked-grain selector of the present invention.
Figure 3A:
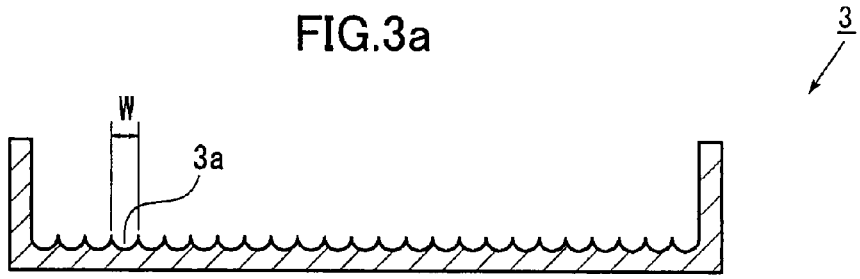
FIGS. 3*a* and 3*b* are sectional views of the slanted chute of the optical cracked-grain selector of the present invention.

FIG. 1 is a vertical side sectional view of an optical cracked-grain selector 1 of the present invention. FIG. 2 is an enlarged view of the main parts of that optical cracked-grain selector 1. The optical cracked-grain selector 1 is composed of a raw material tank 2 that holds material rice grains K, a vibrating feeder 4 that sends in succession material rice grains expelled from the raw material tank 2 to a slanted chute 3 that is described later, and the downwardly slanting slanted chute 3. In the present embodiment, the angle of the downward slant of the slanted chute 3 is 45 degrees. A plurality of adjacent grooves in the downward direction are formed in a slanted surface of the slanted chute 3 so as to align the individual grains of raw rice K in the long direction of the rice grains and pour them downward (see FIG. 3*a*). In the present embodiment, a width W of the grooves 3*a* corresponds to a width of the rice grains K, or 3.3 millimeters. Optical detecting means 6 and selection means 6*a* are positioned in order near the bottom of the slanted chute 3 along the trajectory G of fall of the rice grains.

The optical detecting means 6 comprises a light emitter 7 on one side of the optical detection point P on the trajectory G of fall of the rice grains and a CCD camera 8 on the other side (see FIG. 2). The light emitter 7 comprises a first color light emitter 9 that emits light of a first color (in the present embodiment, green light) toward the optical detection point P and a second color light emitter 10 that emits light of a color different from that of the first color light emitter 9 (in the present embodiment, red light). The first color light emitter 9 is composed of one light emitter 12 provided on one side of the optical axis 11 of the CCD camera 8 and another light emitter 13 provided on the other side of the optical axis 11 of the CCD camera 8. The one light emitter 12 and the other light emitter 13 are positioned so that an interior angle $\alpha 1$ formed by the optical axis (light path) 12*a* of the one light emitter 12 and the optical axis 11 of the CCD camera 8, on the one hand, and an interior angle $\alpha 2$ formed by the optical axis (light path) 13*a* of the other light emitter 13 and the optical axis 11 of the CCD camera 8 on the other hand form substantially the same angle. In the present embodiment, the interior angle $\alpha 1$ and the interior angle $\alpha 2$ are each 25 degrees. It should be noted that both the interior angles $\alpha 1$, $\alpha 2$ are within the range of substantially the same angle described above even if the interior angles $\alpha 1$, $\alpha 2$ differ slightly due to positional errors in the assembly of the CCD camera 8 and the light emitter 7. At the same time, the second color light emitter 10 is positioned so that an optical axis 10*a* of the second color light emitter 10 does not coincide with the optical axis 11 of the CCD camera 8.

The one light emitter 12 and the other light emitter 13 that form the first color light emitter 9, and the second color light emitter 10, are each capable of emitting directional light toward the optical detection point P. Although line laser light emitters, for example, may be used as these emitters, it is more preferable to use LEDs (light emitting diodes) for this purpose because there is little lateral direction difference in emitted light. Where LEDs are used, each emitter is composed of an LED element 13*b* and a condenser lens 13*c* as shown in FIG. 2, with the light emitted by the LED element 13*b* concentrated by the condenser lens 13*c* as indicated by the dotted lines shown in FIG. 2 so as to be directed toward the optical detection point P in a straight line.

The first color light emitter 9 using an LED uses green light of from 500 nm to 580 nm, with the LED element used in the present embodiment having a center wavelength of 520 nm and a half-width of 50 nm. The second color light emitter 10 also using an LED uses red light of from 600 nm to 710 nm, with the LED element used in the present embodiment having a center wavelength of 630 nm and a half-width of 18 nm. It should be noted that, in the present embodiment, as described above it is sufficient if the first color light emitter 9 and the second color light emitter 10 emit light of colors different from each other. Therefore, in addition to the combination of green light and red light as in the embodiment described above, a combination with blue light of a wavelength of from 400 nm to 520 nm may be used. Adjustment of the amount of light of the first color light emitter 9 and the second color light emitter 10 is described later.

Figure 4:
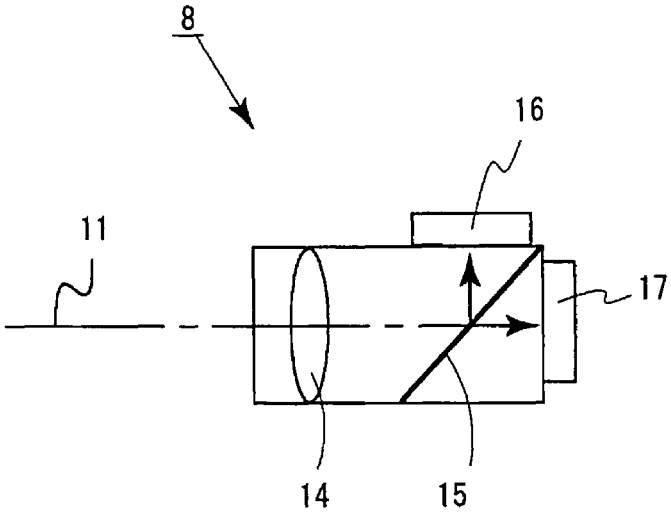
FIG. 4 is a schematic structural view inside a CCD camera of the optical cracked-grain selector of the present invention.

Inside the CCD camera 8, as shown in FIG. 2 and FIG. 4, are disposed, in order from a direction from which light enters the CCD camera 8, a dichroic prism (light splitting means) 15, a color CCD line sensor (first CCD sensor) 16 and another color CCD line sensor (second line sensor) 17. Red light generated by the light splitting action of the dichroic prism (light splitting means) 15 from light that has passed though the rice grain K at the optical detection point P is detected by the color CCD line sensor 16, while green light similarly generated by the light splitting action of the dichroic prism (light splitting means) 15 from light that has passed though the rice grain K at the optical detection point P is detected by the color CCD line sensor 17. The color CCD line sensors 16 and 17 are each connected to a crack determining means 18 so that data on detected light passed though the rice grain (in the form of electrical signals) is sent to the crack determining means 18.

Figure 3B:
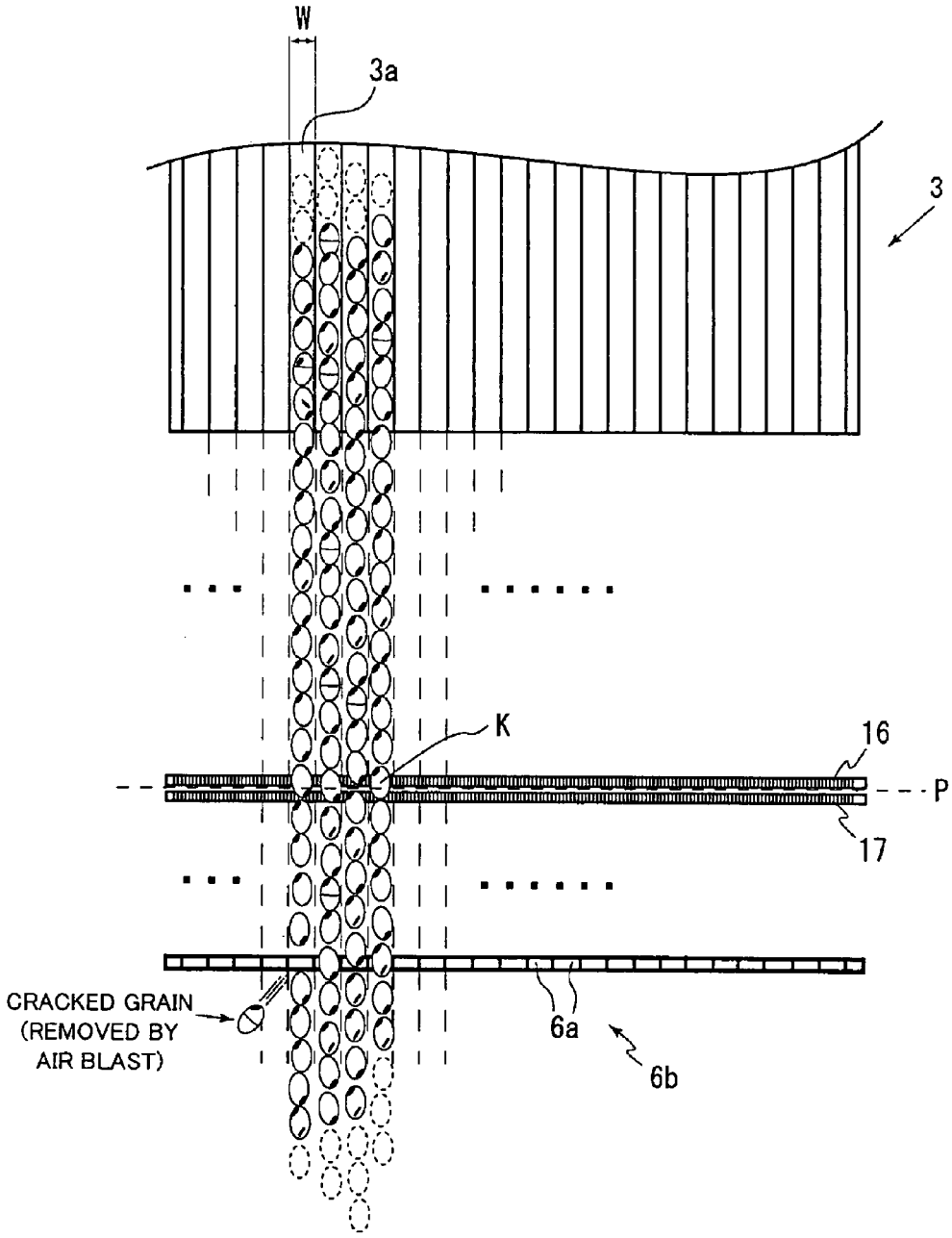

The color CCD line sensors 16 and 17, as shown schematically in FIG. 3*b*, are composed of multiple light receiving sections connected in a line (a single lateral line), with a plurality of light receiving sections allotted to each of the multiple grooves (channels) of the slanted chute 3 so as to be able to receive the light that passes through the falling rice grains K that fall through the grooves channels 3*a*. In addition, by integrating the lens 14, the dichroic prism 15, the color CCD line sensor 16 and the color CCD line sensor 17 in a single unit, there is no discrepancy between the two images of the grain of rice formed on the basis of the light of two different colors that is detected after being passed through the same rice grains K.

The selection means 6*a* in the present embodiment is a high-pressure air blasting means 6*a* that generates blasts of high-pressure air like an air gun. However, alternatively, a spring-loaded mechanism using a solenoid may be employed as the selection means 6*a*. The high-pressure air blasting means 6*a* is provided with a nozzle 6*b* in which multiple blast ports 6*c* are connected in such a way that one blast port 6*c* is aligned with each groove (channel) 3*a* (see FIG. 3*b*) so as to blast high-pressure air toward the trajectory G of fall of the falling rice grains at a position below that of the optical detection point P. The blast ports 6*c* of the nozzle 6*b* are each connected to a solenoid valve by piping, with each solenoid valve communicating with a source of high-pressure air. The solenoid valves are connected to an ejector valve drive means 25, and open and close instantaneously upon receiving a blast signal from the ejector valve drive means 25, thus enabling unsuitable grains to be removed from the trajectory G of fall by an instantaneous blast of high-pressure air like that from an air gun.

Figure 5:
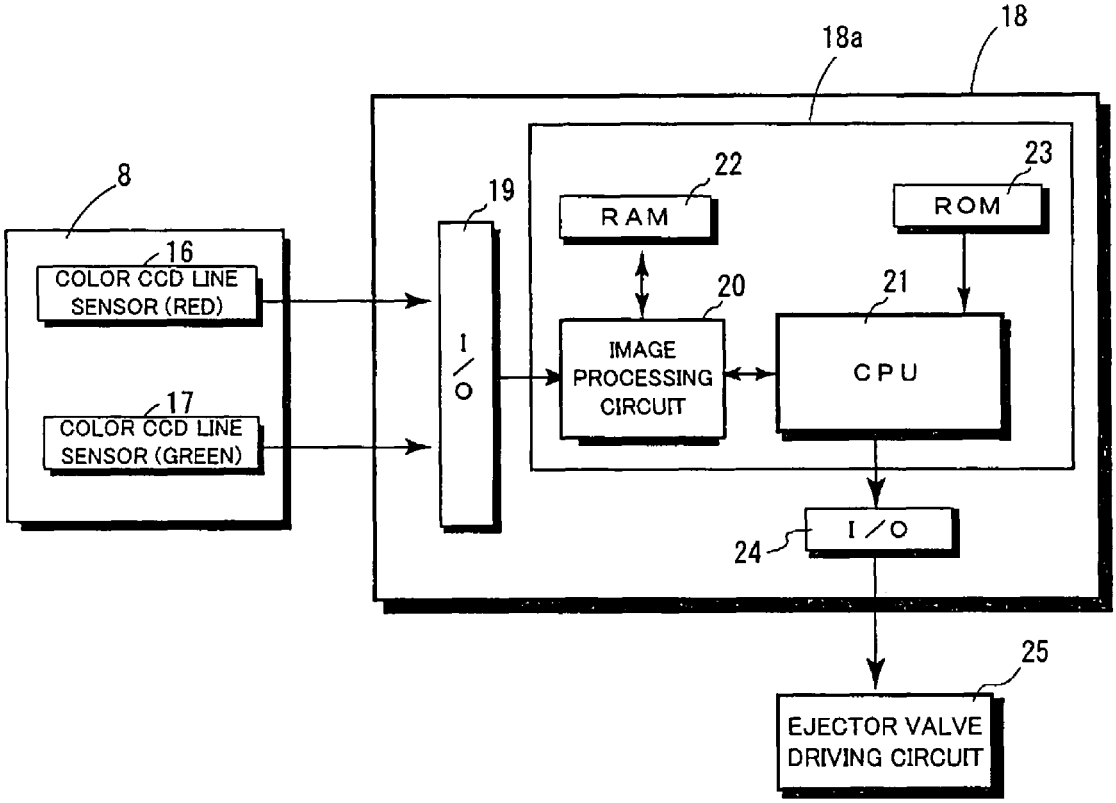
FIG. 5 is a block diagram of crack determining means of the optical cracked-grain selector of the present invention.

The crack determining means 18, as shown in FIG. 5, is composed of an input/output circuit (I/O) 19 connected to each of the color CCD line sensors 16 and 17 built into the CCD camera 8, an image processing circuit 20 connected to the input/output circuit 19, a central processing unit (CPU) 21 and a read/write memory (RAM) 22 both connected to the image processing circuit 20, a read-only memory (ROM) connected to the central processing unit 21, and another input/output circuit (I/O) 24. In addition, the input/output circuit 24 is connected to the ejector valve drive means 25. In the present embodiment an identification unit 18*a* indicates the image processing circuit 20, the central processing unit 21, the read/write memory 22 and the read-only memory 23.

Next, a description is given of the operation of the present invention.

The material rice grains K are supplied in succession to the upstream end of the slanted chute 3 from the raw material tank 2 by the vibration of the vibrating feeder 4 that is conveying means 5. The material rice grains K supplied to the slanted chute 3 enter the grooves 3*a* and are expelled downstream to the end while the direction (orientation) of the rice grains is straightened so that the rice grains are aligned in their long direction. The material rice grains K thus expelled fall along the trajectory G of fall in the orientation described above and are irradiated when they pass the optical detection point P by the green light emitted from the first color light emitter 9 and the red light emitted from the second color light emitter 10, which are always lit.

The CCD camera 8 detects light passed through the rice grains K irradiated by the green and red light at the optical detection point P. This passed light is then split into green light and red light by the dichroic prism 15 after passing through the lens 14 of the CCD camera 8. The green passed light is scanned (received) by the color CCD line sensor 17 and the red passed light is scanned (received) by the color CCD line sensor 16.

Figure 6A:
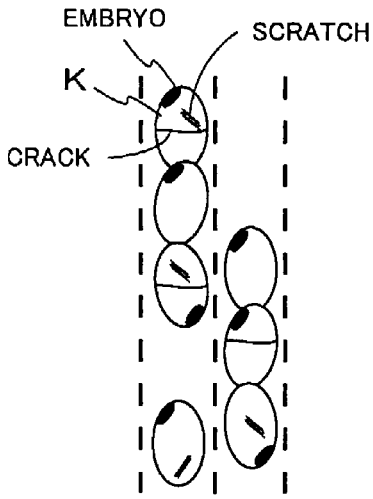
FIGS. 6*a* and 6*b* are a first rice grain image and a second rice grain image obtained by operation of the optical cracked-grain selector of the present invention.

The received light signals (red) that the color CCD line sensor 16 scans are sent in succession to the image processing circuit 20 through the I/O 19 of the crack determining means 18. The image processing circuit 20, based on the detected red light passed through the rice grains, forms images of the rice grains at the optical detection point P. The rice grain images thus created on the basis of the red light passed through the rice grain become the first rice grain images shown in FIG. 6*a*, in which cracks, embryos, and scratches show up in the overall shape of the rice grains. These first rice grain images are successively stored in the RAM 22.

Figure 6B:
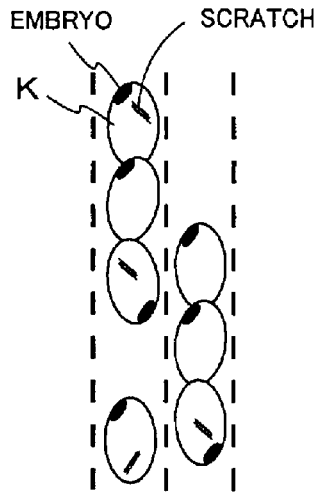

By contrast, the received light signals (green) that the color CCD line sensor 17 scans are similarly sent in succession to the image processing circuit 20 through the I/O 19 of the crack determining means 18. The image processing circuit 20, based on the detected green light passed through the rice grains, forms images of the rice grains at the optical detection point P. The rice grain images thus created on the basis of the green light passed through the rice grains become the second rice grain images shown in FIG. 6*b*, in which only embryos and scratches show up in the overall shape of the rice grain and cracks do not appear.

The cracks do not appear in the second rice grain images (that is, are not detected) because the light emitted from the one light emitter 12 and the other light emitter 13 impinge on the cracks the rice grains (cracked grains) K at the optical detection point P from the same angle (interior angle $\alpha 1$=interior angle $\alpha 2$) with respect to the optical axis 11 of the CCD camera 8 so that dark shadows that may appear by the light being refracted by the cracks are cancelled each other out, whereas when light irradiates the rice grains (cracked grains) from one oblique direction only the light is refracted by the cracks and dark shadows appear on the surface of the rice grain. It should be noted that the crack in the rice grain usually extends in a direction substantially perpendicular to a longitudinal direction of the rice grain. Therefore, the crack in the rice grain ejected from the slanted chute 3 extends substantially on a plane including the optical axis 11 of the CCD camera 8 at the optical detection point P. The effect is the same so long as the interior angles $\alpha 1$, $\alpha 2$ are 70 degrees or less. Once the interior angle exceeds 70 degrees, the dark shadows of the cracks are emphasized and are not completely cancelled out, and moreover, the detection accuracy of scratches and embryos also declines. It should be noted that the second rice grain images (FIG. 6*b*) are successively stored in the RAM 22.

Figure 7:
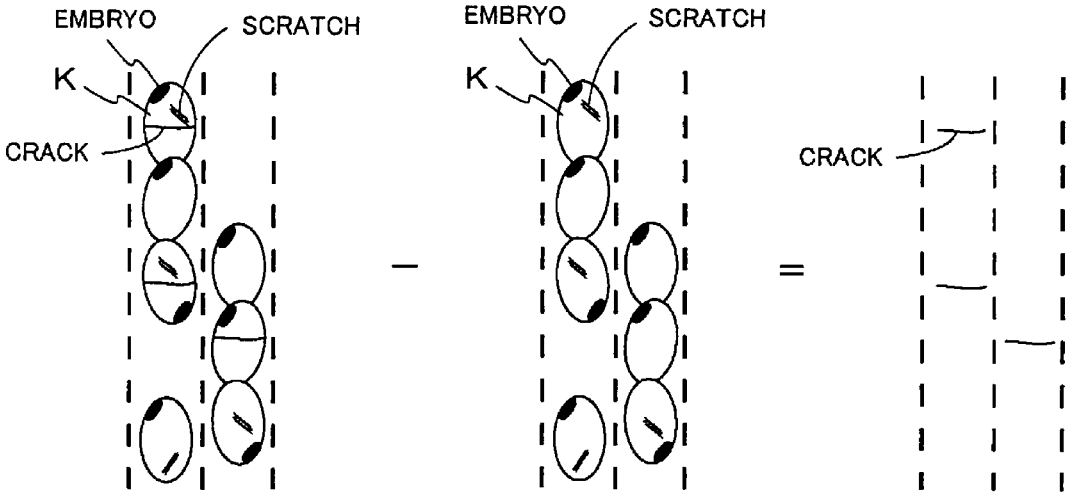
FIG. 7 illustrates a process of subtracting the second rice grain image from the first rice grain image in the operation of the optical cracked-grain selector of the present invention.

Next, the first rice grain images and the second rice grain images are read from the RAM 22 and a process of calculation is carried out in which an amount of light of the second rice grain images (showing only the embryo and scratches) is subtracted from an amount of light of the first rice grain images (showing cracks, embryos and scratches) (see FIG. 7). This process of subtraction cancels out both the embryos and the scratches, so that only cracks remain in the images obtained. By this process can images of cracks that contain only cracks be obtained.

It should be noted that it is necessary to adjust in advance the amounts of light of the first color light emitter 9 and the second color light emitter 10 so that by the subtraction process the images (light amounts) of the embryos, the images (light amounts) of the scratches, and the outlines of the rice grains cancel each other out and to the extent possible do not remain, leaving only images of cracks. In the event that faint traces of the images (light amounts) of the embryos, the images (light amounts) of the scratches, and the images of the outlines of the rice grains remain, these may be digitized using a threshold value for distinguishing between these light amounts and the light amounts of images of cracks so that only images of cracks stand out.

A more detailed description is now given of the subtraction process illustrated in FIG. 7, with reference to FIGS. 8*a*-8*e*. For descriptive convenience, light amounts (wave forms) of a cross-section of a rice grain in the above-described first rice grain image (showing cracks, embryos and scratches) and the same rice grain in the above-described second rice grain image (showing only embryos and scratches) (a sequence of continuously sensed image data) is graphed, and the subtraction process is described in detail using these light amounts (wave forms).

First, FIG. 8*b* shows the amounts of light (wave forms) at the cross-sections of the first rice grain image and the second rice grain image. As can be seen in the drawing, the crack, the embryo and the scratch are detected in the wave forms. Next, the difference between the two wave forms shown in FIG. 8*b* is calculated. As a result, the wave form shown in FIG. 8*c* is obtained, by which the embryos and the scratches in the two rice grain images cancel each other out and a wave form with a depression that corresponds to the crack is detected. Next, the crack wave form level shown in FIG. 8*c* is raised from the negative region to the positive region to produce the wave form shown in FIG. 8*d*. Further, a process of differential calculus is performed on the wave form shown in FIG. 8*d* to sharpen the wave form of the crack. The wave form produced by this process is shown in FIG. 8*e*. Thus the light amount subtraction process involving the first rice grain image and the second rice grain image is performed in units of rice grain cross-sections (that is, a sequence of continuously sensed image data), leaving only images of cracks.

Next, the CPU 21 counts the number of pixels of the remaining crack image as described above. This count number is then compared with a threshold value used to identify cracks and set in advance in the ROM 23, specifically, with a continuous number of pixels used to identify cracks. If the results of the comparison indicate that the number of pixels of the remaining crack image equals or exceeds the threshold value, then the rice grain in question is determined to be (is identified as) a cracked grain. By contrast, if the count number is below the threshold, then the crack is cancelled and the grain in question is not deemed to be a cracked grain.

Next, once the grain in question is deemed to be a cracked grain, the CPU 21 outputs a signal to the ejector valve driving circuit 25 via the I/O 24. After a predetermined delay period, the ejector valve driving circuit 25 outputs a blast signal to the solenoid valve of the high-pressure air blasting means 6*a* that corresponds to the groove (channel) in which such cracked grain is detected and operates the solenoid valve, causing the cracked grain to be selected from the trajectory G of fall described above by a blast of air from the corresponding blast port 6*c* of the nozzle 6*b* (air gun). Alternatively, at this point the center or the like of the cracked grain may be detected by a known method (such as that of JP-3722354-B), a signal output to the solenoid valve corresponding to the detected center position, and a blast of air directed toward the center of the cracked grain to more securely select the cracked grain.

Thus, as described above, the present invention can cancel out images of embryos and scratches in the grains of rice and obtain images of cracks that contain just cracks. As a result, when selecting cracked grains for removal, there is no misidentification of a normal grain having no cracks as a cracked grain due to images of embryos and scratches. Accordingly, cracked grains can be correctly identified and selected for removal, thus improving product yield.

Figure 9:
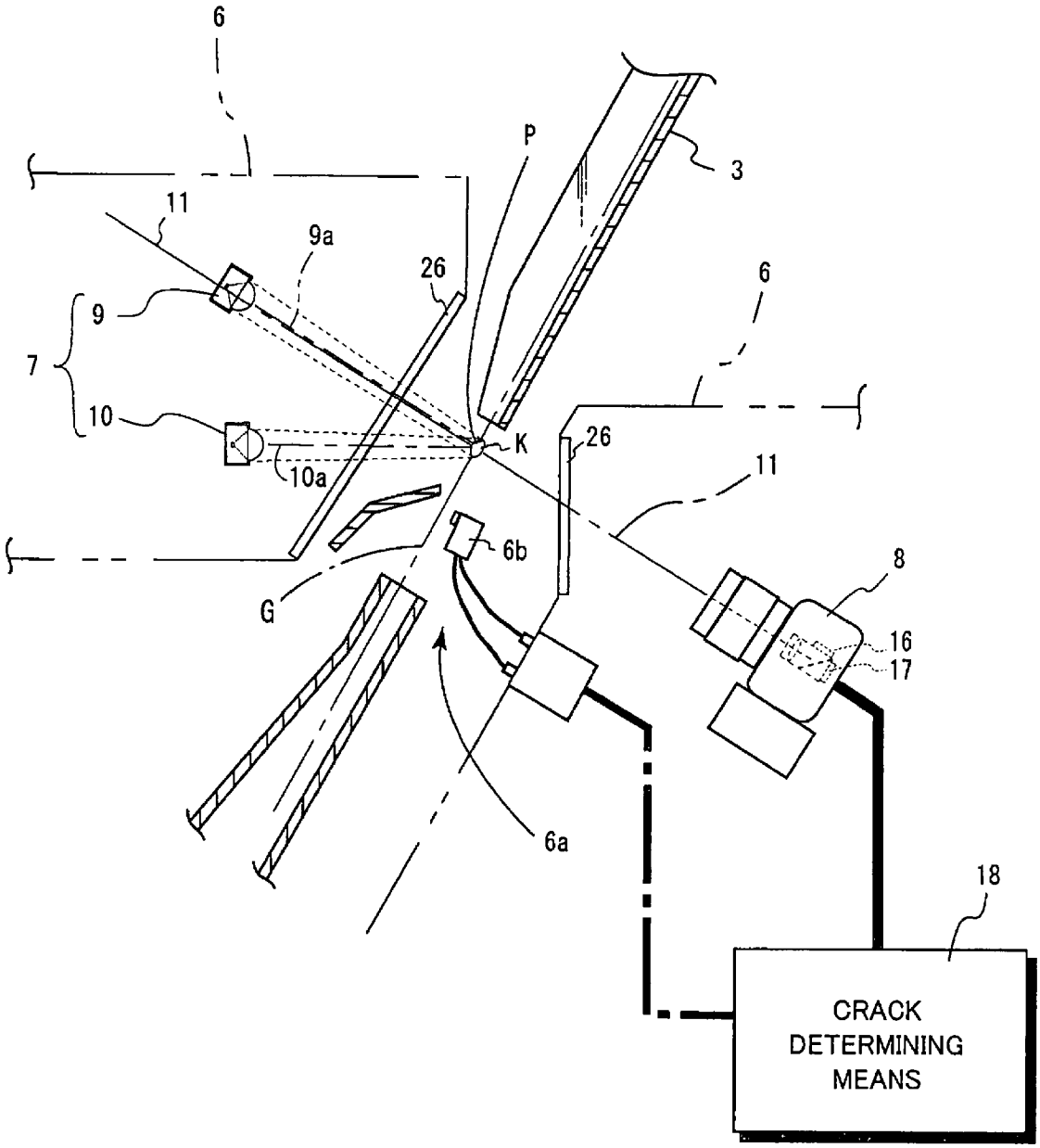
FIG. 9 shows a variation of a first color light emitter of the present invention.
Figure 10:
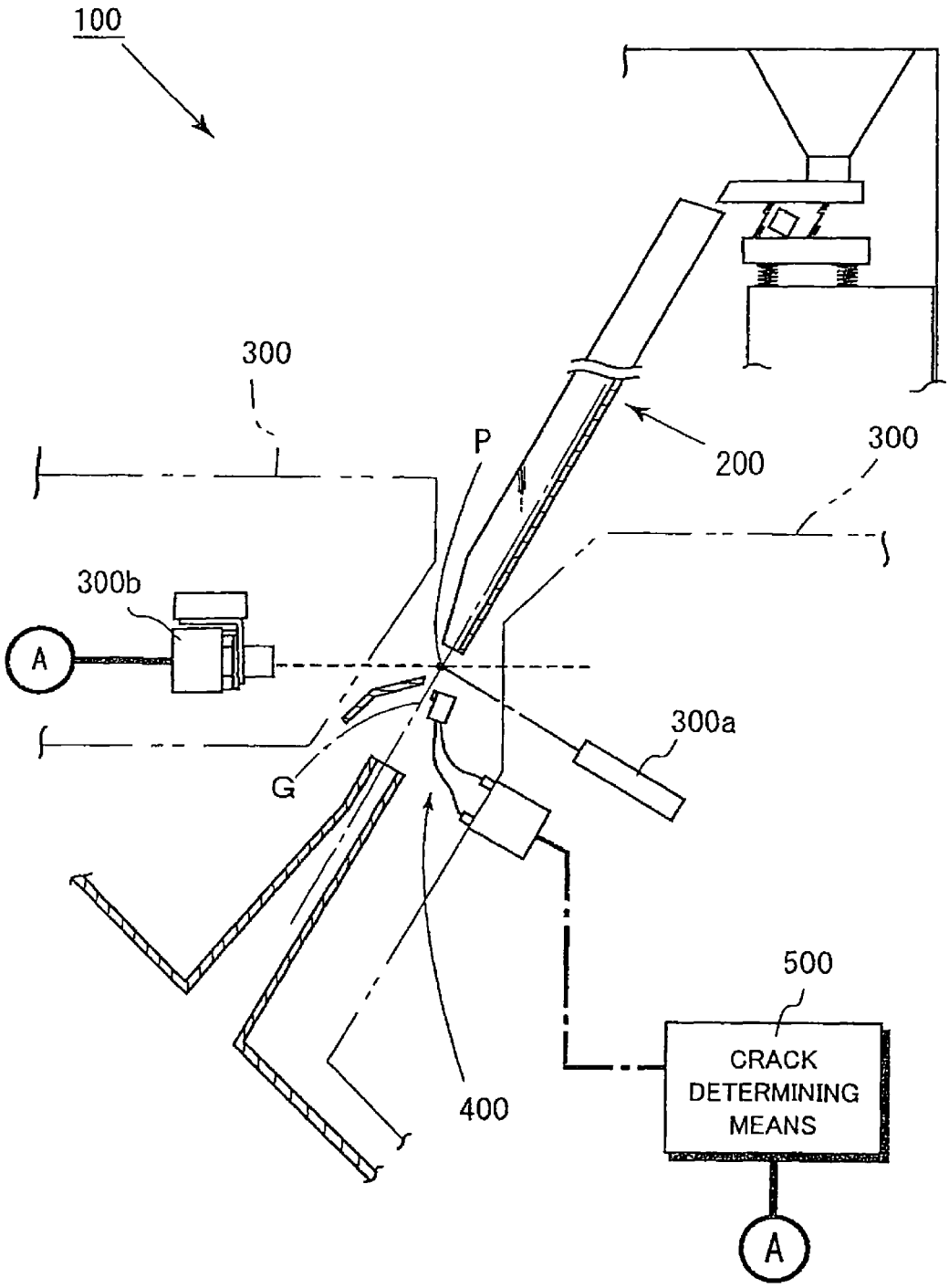
FIG. 10 is a vertical side sectional view of a conventional optical cracked-grain selector.

It should be noted that, although in the embodiment described above the first color light emitter 9 is composed of the one light emitter 12 and another light emitter 13, the first color light emitter 9 may be composed of a single light emitter (see FIG. 9). If the first color light emitter 9 is composed of a single light emitter, then the interior angle must be 0 (zero) and the optical axis of the first color light emitter 9 must coincide with the optical axis 11 of the CCD camera 8 in order to be able to obtain the same effect of the present invention as that described above.

In addition, when obtaining an image of a crack by canceling out the images of the embryos and the scratches by a process of subtraction in the present invention, although in the above-described embodiment the second rice grain image is subtracted for the first rice grain image, conversely, the first rice grain image may be subtracted from the second rice grain image to acquire the image of the crack.

Further, although in the embodiment described above the CCD sensor is composed of the two color CCD line sensors 17 and 16, alternatively, the CCD sensor may be composed of a single color CCD line sensor. In that case, for example, by alternately installing filters that pass green light and filters that pass red light on adjacent light receiving elements in the color CCD line sensor, the above-described first and second rice grain images can be produced based on the received light of each color.

In addition, as a variation of the present invention, the first color light emitter 9 and the second color light emitter 10 may be lit alternatingly, with the light receiving sensors (the CCD sensors) each configured to receive light of a single color (a single wavelength) and the two CCD sensors receiving light by the respective lighting of the two color light emitters so as to produce the first and second rice grain images described above based on the received light data thus obtained.

As many apparently widely different embodiments of the present invention can be made without departing from the spirit and scope thereof, it is to be understood that the invention is not limited to the specific embodiments thereof except as defined in the appended claims.

What is claimed is:

1. A cracked rice-grain identification unit, comprising:

a conveying unit conveying rice grains aligned in a plurality of rows;

a light emitting section emitting light of a first color and light of a second color different from the first color toward the rice grains which are ejected from said conveying unit and are moving in one direction;

a camera detecting said light of the first color and said light of the second color, emitted from said light emitting section, which have passed through the rice grains;

a cracked rice-grain determining unit determining whether the rice grains have a crack or not based on said light of the first color and said light of the second color which are detected by said camera, wherein said camera is arranged opposite said light emitting section with respect to the rice grains such that an optical axis of the camera is perpendicular to the direction in which the rice grains are moving;

said light emitting section includes a first-color light emitter emitting said light of the first color and a second-color light emitter emitting said light of the second color;

said first-color light emitter includes a first emitting unit and a second emitting unit, arranged on opposite sides of the optical axis of the camera, and the first and second emitting units emit said light of the first color toward the rice grains with the same emitting angles with respect to the optical axis of the camera;

said second-color light emitter includes a third emitting unit arranged on one side of said optical axis of the camera, and the third emitting unit emits said light of the second color toward the rice grains with a predetermined emitting angle with respect to the optical axis of the camera;

said camera has a unit dispersing said light of the first color and said light of the second color, detected by said camera, to generate light signals of the first color and light signals of the second color;

said cracked rice-grain determining unit has an image processing unit carrying out an image processing of said light signal of the first color and said light signal of the second color, sent from the camera, to generate first rice-grain images and second rice-grain images, respectively, and a crack-image obtaining unit obtaining only an image of a crack on a rice grain, which does not appear on the first rice-grain images but appears on the second rice-grain images, from the difference between data on said first rice-grain images and data on the second rice-grain images.

2. The cracked rice-grain identification unit according to claim 1, further comprising a selecting unit selecting and removing a rice grain on which said crack-image obtaining unit obtained the image of the crack.

3. A cracked rice-grain identification unit, comprising:

a conveying unit conveying rice grains aligned in a plurality of rows;

a light emitting section emitting light of a first color and light of a second color different from the first color toward the rice grains which are ejected from said conveying unit and are moving in one direction;

a camera detecting said light of the first color and said light of the second color, emitted from said light emitting section, which have passed through the rice grains;

a cracked rice-grain determining unit determining whether the rice grains have a crack or not based on said light of the first color and said light of the second color which are detected by said camera, wherein said camera is arranged opposite said light emitting section with respect to the rice grains such that an optical axis of the camera is perpendicular to the direction in which the rice grains are moving;

said light emitting section includes a first-color light emitter emitting said light of the first color and a second-color light emitter emitting said light of the second color;

said first-color light emitter includes a first emitting unit arranged on said optical axis of the camera and a second emitting unit arranged on one side of said optical axis of the camera, and the first emitting unit emits said light of the first color toward the rice grains along the optical axis of the camera and the second emitting unit emits said light of the second color toward the rice grains with a predetermined emitting angle with respect to the optical axis of the camera;

said camera has a unit dispersing said light of the first color and said light of the second color, detected by said camera, to generate light signals of the first color and light signals of the second color;

said cracked rice-grain determining unit has an image processing unit carrying out an image processing of said light signals of the first color and said light signals of the second color, sent from the camera, to generate first rice-grain images and second rice-grain images, respectively, and a crack-image obtaining unit obtaining only an image of a crack on a rice grain, which does not appear on the first rice-grain images but appears on the second rice-grain images, from the difference between data on said first rice-grain images and data on the second rice-grain images.

4. The cracked rice-grain identification unit according to claim 3, further comprising a selecting unit selecting and removing a rice grain on which said crack-image obtaining unit obtained an image of a crack.

* * * * *